US010407923B2

(12) United States Patent
Psaila

(10) Patent No.: US 10,407,923 B2
(45) Date of Patent: Sep. 10, 2019

(54) TILE EDGE SETTING DEVICE AND A METHOD OF OPERATION THEREOF

(71) Applicant: ATR Plastics Pty Ltd, Melbourne (AU)

(72) Inventor: Andy Psaila, Melbourne (AU)

(73) Assignee: ATR PLASTICS PTY LTD, Melbourne (AU)

( * ) Notice: Subject to any disclaimer, the term of this patent is extended or adjusted under 35 U.S.C. 154(b) by 0 days.

(21) Appl. No.: 15/737,190

(22) PCT Filed: Jun. 15, 2016

(86) PCT No.: PCT/AU2016/050494
§ 371 (c)(1),
(2) Date: Dec. 15, 2017

(87) PCT Pub. No.: WO2016/201502
PCT Pub. Date: Dec. 22, 2016

(65) Prior Publication Data

US 2018/0163415 A1 Jun. 14, 2018

(30) Foreign Application Priority Data

Jun. 15, 2015 (AU) ..... 2015902263

(51) Int. Cl.
*E04F 21/22* (2006.01)
*E04F 21/00* (2006.01)

(52) U.S. Cl.
CPC ..... *E04F 21/22* (2013.01); *E04F 21/0092* (2013.01)

(58) Field of Classification Search
CPC ..... E04F 21/22; E04F 21/0092
(Continued)

(56) References Cited

U.S. PATENT DOCUMENTS 7,946,093 B1 * 5/2011 Sturino ..... E04F 21/0092 33/527
7,954,300 B1 * 6/2011 Kufner ..... E04F 21/22 33/526

(Continued)

FOREIGN PATENT DOCUMENTS

AU 2014100939 9/2014

OTHER PUBLICATIONS

International Search Report & Written Opinion dated Aug. 15, 2016 from corresponding PCT Application No. PCT/AU2016/050494.

*Primary Examiner* — Brian E Glessner
*Assistant Examiner* — Adam G Barlow
(74) *Attorney, Agent, or Firm* — Innovation Capital Law Group, LLP; Vic Lin

(57) ABSTRACT

There is provided a device for tile edge setting and the method of operation thereof. The device comprises upper and lower clamping members and an elongate stem coupled to the upper clamping member by way of an offset adjusting mechanism. The stem is releasably coupled to the lower clamping member by way of a releasable coupling mechanism wherein the lower clamping member defines an elongate connection recess having a lengthwise axis and having inner side walls defining opposing inwardly orientated recess mating formations and the stem defines an interstitial strap portion having a distal mating end for releasable coupling within the connection recess, the mating end defining opposing outwardly orientated strap mating formations for simultaneously engaging the respective inwardly orientated recess mating formations of the connection recess such that, the mating end is able to travel widthwise along the lengthwise axis of the connection recess until the opposing outwardly orientated strap mating formations disengage from the opposing inwardly orientated recess mating for- (Continued)

mations to release the mating end from the elongate connection recess.

20 Claims, 13 Drawing Sheets

(58) Field of Classification Search
USPC ..... 52/126.1, 126.5, 126.6
See application file for complete search history.

(56) References Cited

U.S. PATENT DOCUMENTS 8,429,879 B1 4/2013 Hoffman et al.
9,097,026 B2 * 8/2015 Hoffman ..... E04F 21/22
9,279,259 B1 * 3/2016 Russo ..... E04F 21/20
9,322,185 B1 * 4/2016 Russo ..... E04F 21/0092
9,328,522 B2 * 5/2016 Bordin ..... E04F 21/20
9,874,032 B1 * 1/2018 Chen ..... E04F 21/20
10,053,872 B2 * 8/2018 Sighinolfi ..... E04F 21/0092
2010/0263304 A1 * 10/2010 Torrents I Comas ..... E04F 21/0092 52/126.5
2013/0067854 A1 * 3/2013 Bordin ..... E04F 21/0092 52/749.11
2013/0247508 A1 * 9/2013 Hoffman ..... E04F 21/00 52/749.11
2014/0325935 A1 11/2014 Hoffman et al.
2014/0325936 A1 * 11/2014 PSaila ..... E04F 21/1877 52/749.11
2015/0184355 A1 * 7/2015 Wang ..... E02D 35/005 52/126.1
2015/0211243 A1 * 7/2015 Irvine ..... E04F 21/0092 52/126.1
2015/0240504 A1 * 8/2015 Hoffman ..... E04F 21/20 29/244
2015/0267420 A1 * 9/2015 Fontana ..... E04F 13/0892 52/126.1
2016/0348381 A1 * 12/2016 Meyers ..... E04F 21/1877
2016/0369518 A1 * 12/2016 Sarajian ..... E04F 21/22
2018/0030742 A1 * 2/2018 Lazaro Florensa ..... E04F 15/02
2018/0080237 A1 * 3/2018 Chen ..... E04F 21/0092
2018/0163415 A1 * 6/2018 Psaila ..... E04F 21/22

* cited by examiner

TILE EDGE SETTING DEVICE AND A METHOD OF OPERATION THEREOF

FIELD OF THE INVENTION

The present invention relates to tiling devices and apparatus and in particular, but not necessarily entirely, to a tile edge setting device and a method of operation thereof.

BACKGROUND

FIG. 1 shows a prior art system disclosed in U.S. Pat. No. 8,429,879 B1 (hereafter D1) for mechanical edge setting system and method for setting tiles and tuning lippage.

D1 discloses a sub tile base member 740 is configured with a strap receiving void 770 for receiving therein a reusable strap 800. The sub tile base member 740 is specially designed to allow the reusable strap 800 to be removed from attachment thereto by severing the various strap mating members.

FIG. D2 shows a further prior art system disclosed in US 20140325935 A1 (hereafter D2) being a tool-less swing arm mechanical edge setting system and method for setting tiles and tuning lippage.

D1 discloses an under tile detachable plate 206 which is configured with a strap receiving void for receiving therein an interstitial strap 110. The under tile detachable plate 206 is specially designed to allow the interstitial strap 110 to be removed from attachment thereto by severing the various multi-diameter stepped plates to strap mating pins 602. These pins of D2 may be made so that they can be relatively easily broken and thereby facilitate removal of interstitial strap 110 by forcibly separating it from the multi-diameter stepped plate to strap mating pins 602.

In another embodiment, D2 discloses the plate to strap mating pin enlarged terminal portion 604 have a larger end, which is designed to facilitate ease of insertion followed by retention of interstitial strap 110 on the multi-diameter stepped plate to strap mating pins 602 during the process of using the system to reduce lippage. The insertion process can be reversed, and the plate to strap mating pin enlarged terminal portion 604 can be aligned with enlarged terminal portion receiving hole 702, so as to be easily removed through the enlarged portions.

The present invention seeks to provide a device for tile edge setting, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

According to one aspect, there is provided a device for tile edge setting, the device comprising: clamping members comprising: an upper clamping member defining a downward acting clamping face; an under tile lower clamping member defining an upward acting clamping face; and an elongate stem for urging the clamping members together, wherein: the elongate stem is coupled to the upper clamping member by way of an offset adjusting mechanism configured for adjusting the relative offset of the stem with respect to the upper clamping member; and the stem is releasably coupled to the lower clamping member by way of a releasable coupling mechanism wherein: the lower clamping member defines an elongate connection recess having a lengthwise axis and having inner side walls defining opposing inwardly orientated recess mating formations, the inwardly orientated recess mating formations being symmetric along the lengthwise axis of the connection recess; and the stem defines an interstitial strap portion having a distal mating end for releasable coupling within the connection recess, the mating end defining opposing outwardly orientated strap mating formations being symmetric along the widthwise axis of the mating end and each outwardly orientated strap mating formation configured for simultaneously engaging the respective inwardly orientated recess mating formations of the connection recess, wherein, in use: the releasable coupling mechanism is configured such that, the mating end is able to travel along the lengthwise axis of the connection recess until the opposing outwardly orientated strap mating formations disengage from the opposing inwardly orientated recess mating formations to release the mating end from the elongate connection recess.

The lower clamping member may be substantially plate-like

The depth of the connection recess may be less than the adjacent thickness of the lower clamping member such that the connection recess may define a connection recess floor.

The length of the elongate connection recess may be less than the width of the lower clamping member along the lengthwise axis of the connection recess.

The connection recess may be substantially horizontally centrally located within the lower clamping member.

The connection recess may have an end wall located to limit the travel of the mating end along the lengthwise axis of the connection recess so as to locate the stem substantially horizontally centrally with respect to the lower clamping member.

The lower clamping member may further may define a disconnection recess in line with the lengthwise axis of the connection recess and adjoining one end of the connection recess and wherein the disconnection recess may have a width greater than the width of the connection recess and a length equal or greater than the width of the mating end so as to allow for the disengagement of the outwardly orientated strap mating formations from the inwardly orientated recess mating formations.

The disconnection recess may be funneled towards the connection recess.

The depth of the disconnection recess may be less than the adjacent thickness of the lower clamping member such that the disconnection recess may define a disconnection recess floor.

The disconnection recess floor may be ramped away from the elongate connection recess.

The connection recess floor and the disconnection recess floor may be vertically aligned so as to allow for the correct alignment for the meshing of the outwardly orientated strap mating formations and the inwardly orientated recess mating formations when the bottom edge of the mating end bears against at least one of the connection recess floor and the disconnection recess floor.

The outwardly orientated strap mating formations may comprise teeth being symmetric along the widthwise axis of the mating end.

The opposite teeth may be respectively vertically staggered.

The teeth have an upwardly orientated saw tooth cross section configuration.

The interstitial strap portion may comprise a release direction indicator.

The outwardly orientated strap mating formations and the inwardly orientated recess mating formations may be directionally keyed such that the mating end can only be inserted into the connection recess in one direction.

The lower surface of the lower clamping member may be substantially convex.

The upper surface of the lower clamping member may be substantially planar.

The offset adjusting mechanism may comprise a screwing mechanism.

The stem may comprise a cylindrical threaded portion for screwing within a complementary threaded aperture portion of the upper clamping member.

The threaded aperture portion may comprise a nut outer profile.

The upper clamping member may define manual screwing facilitating gripping wings.

The lower clamping member may define at least one upwardly projecting grouting spacing member.

The at least one grouting spacing member may be elongate.

The at least one grouting spacing member may be aligned orthogonal the lengthwise axis of the connection recess.

The at least one grouting spacing member may be two grouting spacing members located adjacent the connection recess.

The at least one grouting spacing member may have a thickness substantially the same as the thickness of the interstitial strap portion.

The lower clamping member may further may comprise adhesive ports.

The upper clamping member may have a height of approximately 35 mm.

The upper clamping member may have a width of approximately 45 mm.

The lower clamping member may have a width of approximately 45 mm.

The lower clamping member may have a with substantially the same as that of the upper clamping member.

The mating end may have a width of substantially 7 mm.

The mating end may have a width of substantially 12 mm.

The length of the connection recess may be substantially the same as the width of the mating end.

The interstitial strap portion may have a length of approximately 20 mm.

The interstitial strap portion may have a thickness of approximately 1 mm.

According to another aspect, there is provided a method for reducing tile lippage utilising a device as described herein, the method comprising: providing a tiling surface; smearing tiling adhesive on the tiling surface; placing a tile with one side of the lower clamping member of the device beneath an edge of the tile and with the elongate connection recess aligned in line with the edge of the tile; placing an adjacent tile with an opposite side of the lower clamping member beneath an edge of the adjacent tile; adjusting the offset of the upper clamping member of the device with respect to the stem of the device such that the upper clamping member and the lower clamping member bear oppositely against the respective edges of the tile and the adjacent tile so as to align the edges of the tiles; leaving the adhesive to substantially set; moving the stem laterally between the edges of the tiles such that the mating end of the stem travels from the connection recess of the lower clamping member so as to release the stem from the lower clamping member.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
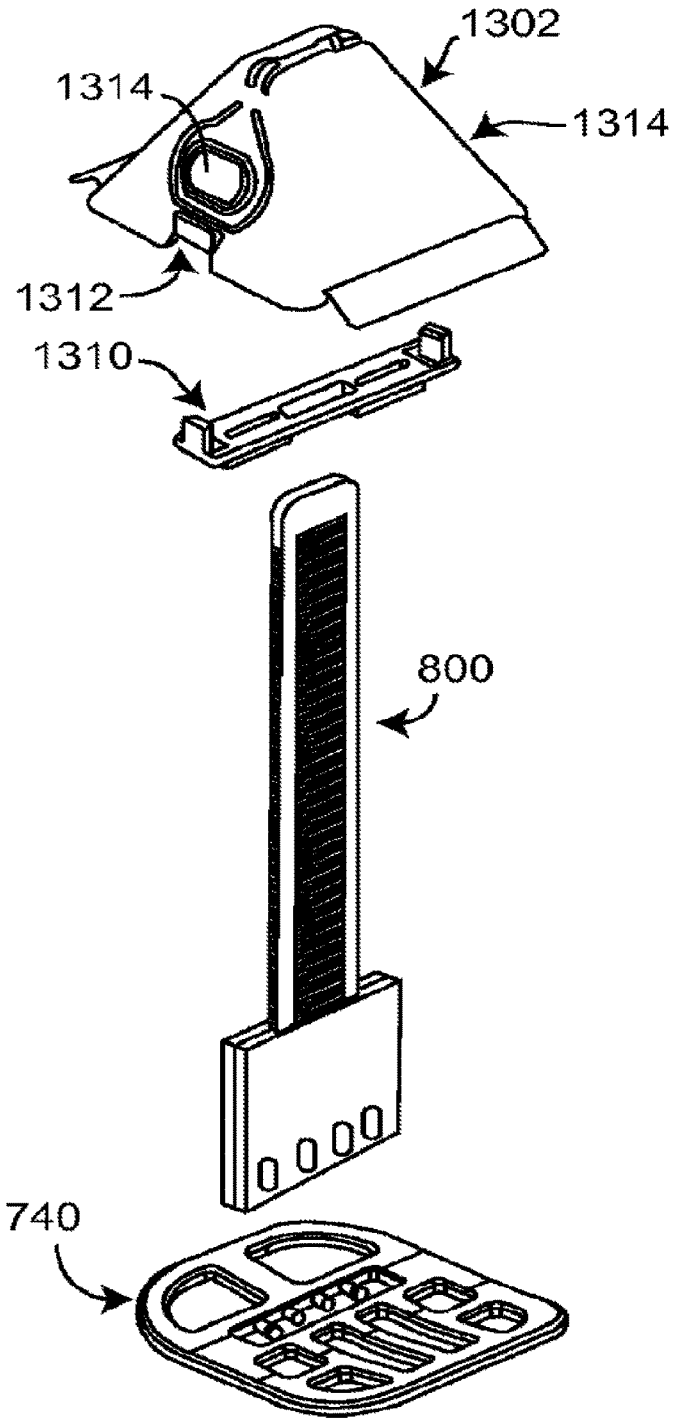
FIGS. 1-2 show prior art arrangements.
Figure 2:
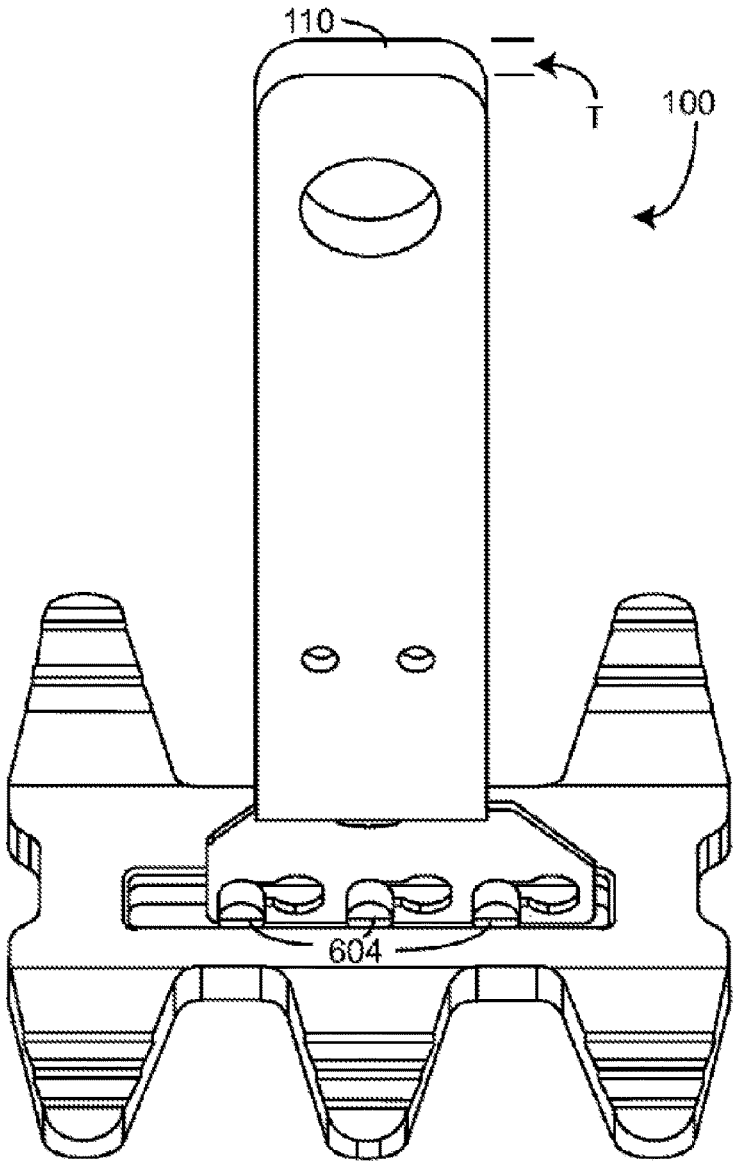

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

Before the structures, systems and associated methods relating to the tile edge setting device and a method of operation thereof are disclosed and described, it is to be understood that this disclosure is not limited to the particular configurations, process steps, and materials disclosed herein as such may vary somewhat. It is also to be understood that the terminology employed herein is used for the purpose of describing particular embodiments only and is not intended to be limiting since the scope of the disclosure will be limited only by the claims and equivalents thereof.

In describing and claiming the subject matter of the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterised by," and grammatical equivalents thereof are inclusive or open-ended terms that do not exclude additional, unrecited elements or method steps.

It should be noted in the following description that like or the same reference numerals in different embodiments denote the same or similar features.

Figure 3:
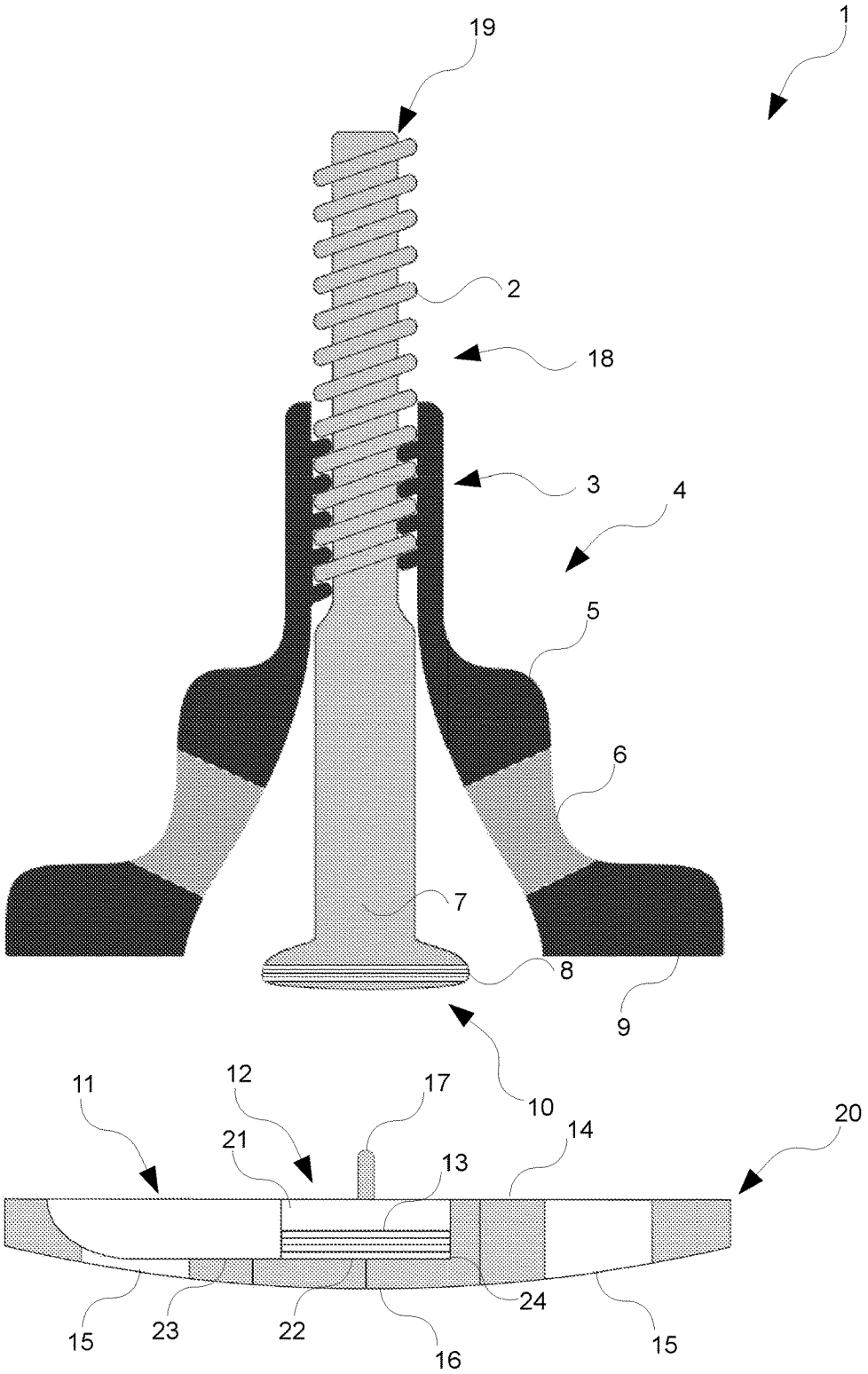
FIG. 3 shows a device for tile edge setting in accordance with an embodiment of the present disclosure.

Turning now to FIG. 3, there is shown a device 1 for edge setting. As will be appreciated from the ensuing description, the device 1 has application for aligning edges of adjacent tiles while setting in the manner described herein.

The device 1 comprises clamping members for clamping the opposing upper and underside surfaces of adjacent tile edges to align the tile edges while setting.

Specifically, the clamping members comprises an upper clamping member for defining a downward acting clamping face 9 for bearing downwardly on the upper surface of the adjacent tile edges. Furthermore, the clamping members further comprise an under tile lower clamping member 20 defining an upward acting clamping face 14 for bearing upwardly on the underside surface of the adjacent tile edges to align the tiles while setting.

The device 20 further comprises an elongate stem 19 for urging the clamping members together.

Now, specifically, the elongate stem 19 is coupled to the upper clamping member 4 by way of an offset adjusting mechanism configured to adjust the relative offset of the stem 19 with respect to the upper clamping member 4.

In this manner, by adjusting the offset of the upper clamping member 4 with respect to the stem 19 the applicant be member 4 may be borne towards the lower clamping member 20 such that the downward acting clamping phase 9 and the upward acting clamping face 14 bear oppositely on the respective upper and underside surfaces of the adjacent tile edges so as to clamp the adjacent tile edges so as to align the tile edges while setting.

Furthermore, the stem 19 is releasably coupled to the lower clamping member 20 by way of a releasable coupling mechanism. Specifically, the releasable coupling mechanism comprises the lower clamping member 20 defining an elongate connection recess 12 configured for engaging a distal end of the stem 19 therein.

Figure 4:
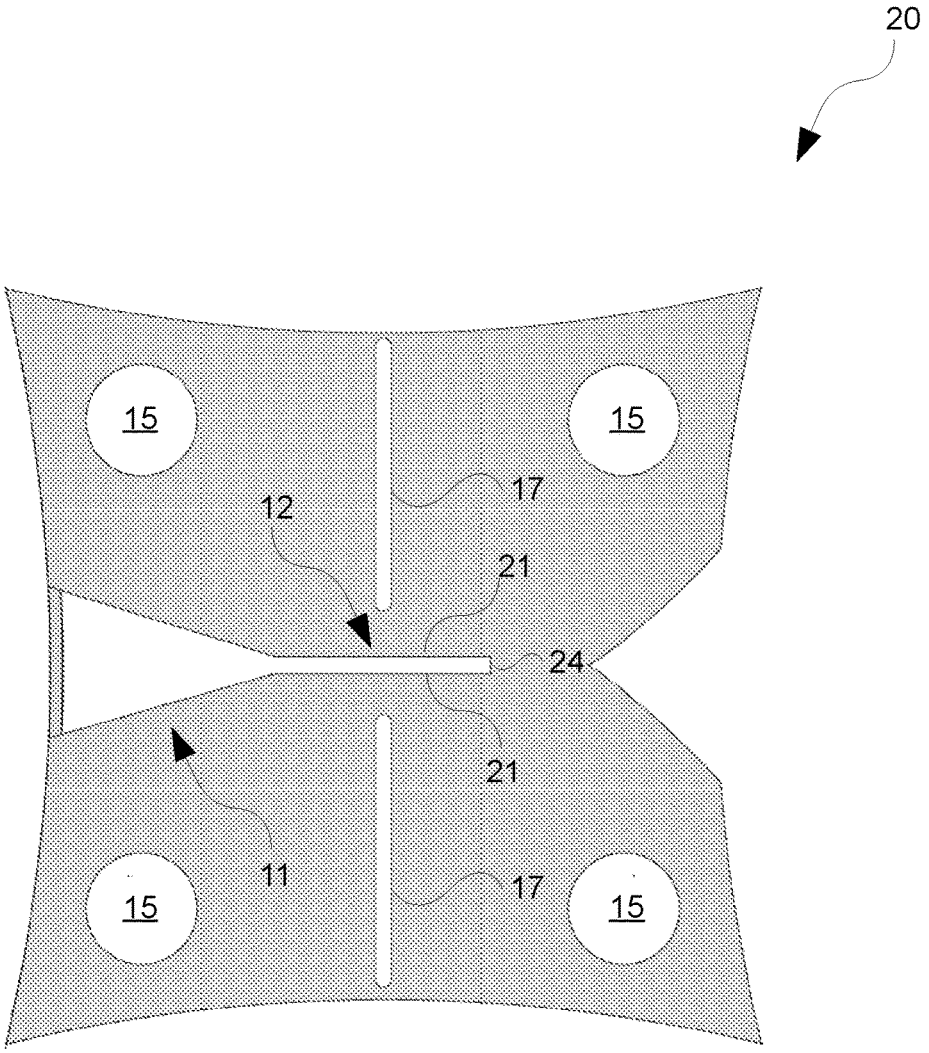
FIG. 4 shows a top plan view of an under tile lower clamping member in accordance with an embodiment of the present disclosure.

Reference is made to FIG. 4 showing a top plan view of the lower clamping member 20 showing the elongate connection recess 12.

Returning again to FIG. 3, the elongate connection recess 12 has a lengthwise axis and has inner sidewalls 21 defining opposing inwardly orientated recess mating formations 13. The inwardly orientated recess mating formations 13 are symmetrical on the lengthwise axis of the connection recess 12 so as to facilitate the sliding of the distal end of the stem 19 along the lengthwise axis of the connection recess 12 for connection and disconnection in the manner described in further detail below.

Considering the stem 19 now in further detail, the stem 19 defines an interstitial strap portion 7 having a distal mating end 10 for releasable coupling within the connection recess 12.

The distal mating end 10 similarly defines opposing outwardly orientated strap mating formations 8 being symmetrical along the widthwise axis of the mating end 10.

In this manner, each opposite outwardly orientated strap mating formation 8 is configured for simultaneously engaging the respective opposite inwardly orientated recess mating formation 13 of the connection recess 12 when the mating end 10 is located within the connection recess 12.

As such, the releasable coupling mechanism is configured such that the mating end 10 is able to travel along the lengthwise axis of the connection recess 12 until the outwardly orientated strap mating formations 8 disengaged from the inwardly orientated recess mating formations 13 to release the mating end 10 from the elongate connection recess 12.

In the embodiment shown in FIG. 3, the mating end 12 has a width greater than that of the interstitial strap 7 for greater purchase surface area. However, in other embodiments, including that which is substantially shown in FIG. 9, the mating end 10 may have a width substantially the same as that of the interstitial strap 7.

As can be seen from FIG. 3, the under tile lower clamping member 20 is preferably substantially plate like so as to be generally suited for under tile location in use. In embodiments, the lower clamping member 20 may comprise a substantially square horizontal cross-section as substantially shown in FIGS. 4 and 5. However, other horizontal cross-sections may be applicable within the purposive scope of the embodiments described herein.

Now, in a preferred embodiment, and as can be seen from FIG. 3, the depth of the connection recess 12 is less than the adjacent thickness of the lower clamping member 20 such that the connection recess defines a connection recess floor 22.

Figure 5:
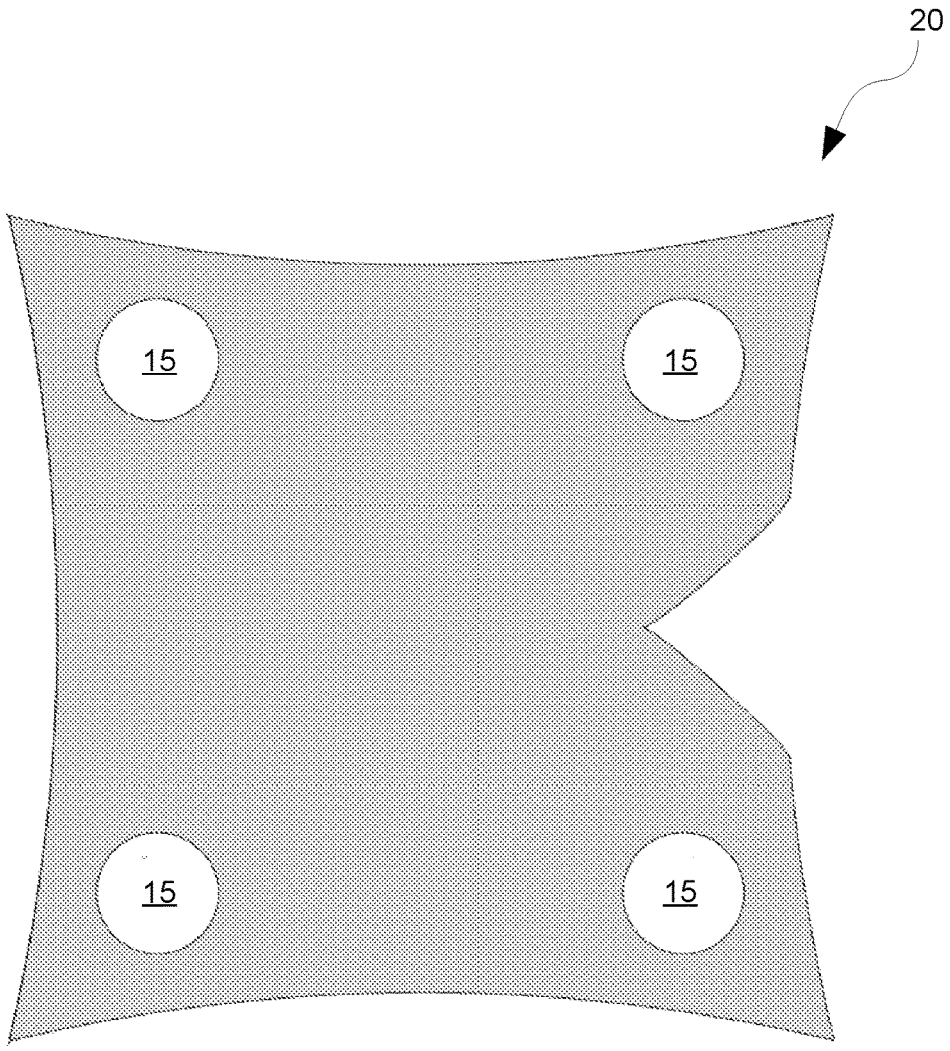
FIG. 5 shows a bottom plan view of the lower clamping member in accordance with an embodiment of the present disclosure.

Specifically, FIG. 4 shows a top plan view of the lower clamping member 20 wherein the connection recess 12 can be seen recessed into the upper surface of the lower clamping member 20 whereas FIG. 5 shows a lower plan view of the lower clamping member 20 wherein, as can be seen, the connection recess 5 does not extend entirely through the lower clamping member 20. In this manner, tile adhesive is substantially prevented from entering the connection recess 12 from beneath, such as were the connection recess 12 bottom open-ended, so as to prevent tile adhesive from hindering the sliding of the mating end 12 from the connection recess 12.

As can be seen from FIG. 4, in embodiments, the length of the elongate connection recess 12 is less than the width of the lower clamping member 20 along the lengthwise axis of the connection recess 12.

Furthermore, as can be seen, in a preferred embodiment, the connection recess 12 is substantially horizontally centrally located within the lower clamping member 20 such that, when the mating ended 10 is engaged within the connection recess 12, the stem 19 is substantially horizontally centrally located with respect to the lower clamping member 20.

In embodiments, the connection recess 12 may have an end wall 24 located to limit the travel of the mating ended 10 along the lengthwise axis of the connection recess 12 so as to locate the stem 19 substantially horizontally centrally with respect to the lower clamping member 20.

Now, in embodiments, the connection recess 12 may run to the edge of the lower clamping member 20. However, in a preferred embodiment, so as to facilitate disengagement with a shorter run, the lower clamping member 20 further defines a disconnection recess 11 in line with the lengthwise axis of the connection recess 12 and adjoining one end of the connection recess 12.

Furthermore, as can be seen from FIG. 4, the disconnection recess 11 has a width of equal or greater than the width of the connection recess 12 and a length equal or greater than the width of the mating end 10 so as to allow the disengagement of the outwardly orientated strap mating formations 8 from the inwardly orientated recess mating formations 13.

Furthermore, in embodiments, and as can be seen from FIG. 4, the disconnection recess 11 may be funneled towards the connection recess 12 so as to guide the mating end 10 to assist in the connection process. Also, as can be seen from FIG. 3, in embodiments, the depth of the disconnection recess 11 is less in the adjacent thickness of the lower clamping member 20 such that the disconnection recess 11 similarly defines a disconnection recess floor 23.

As can be seen, the disconnection recess floor 23 is ramped away from the elongate connection recess 12 so as to urge the stem 19 upwardly when travelling from the connection recess 12.

As can also be seen, the connection recess floor 22 and the disconnection recess floor 23 may be vertically aligned so as to allow for the correct alignment for the meshing of the outwardly orientated strap mating formations 8 and the inwardly orientated recess mating formations 13 when the bottom edge of the mating ended 10 bears against at least one of the connection recess floor 22 and the disconnection recess floor 23.

Figure 7:
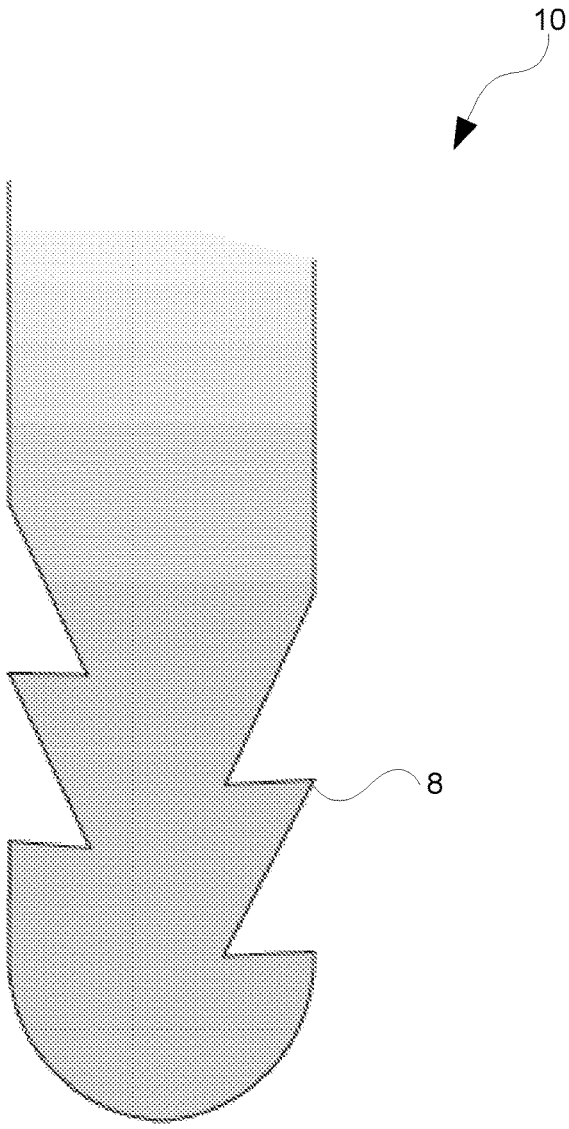
FIG. 7 shows the mating end of the interstitial strap portion of the stem of the device showing the teeth comprising an upwardly orientated saw tooth cross section in accordance with an embodiment of the present disclosure.
Figure 8:
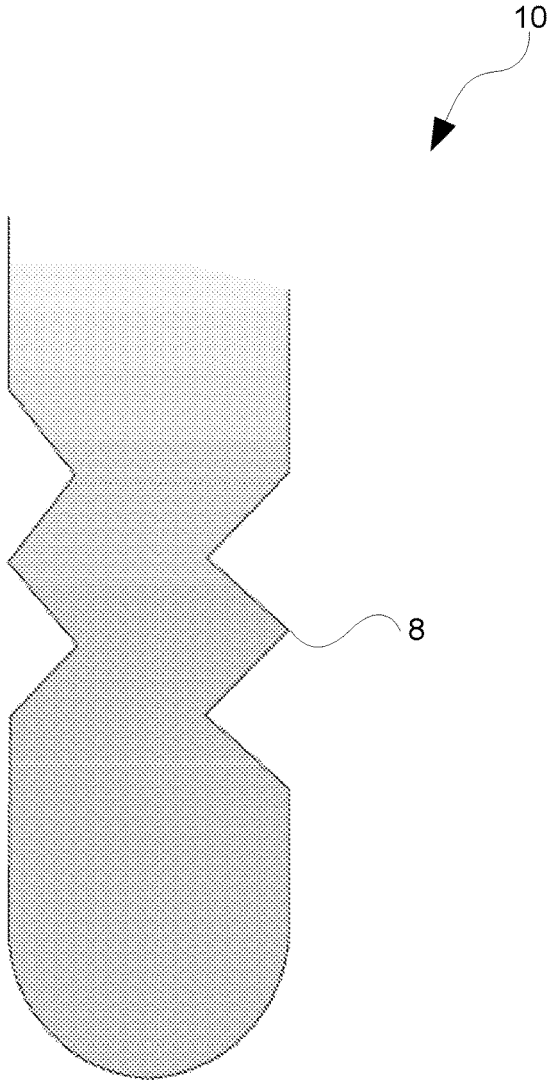
FIG. 8 shows the mating end of the interstitial strap portion of the stem of the device showing teeth in a differing configuration and wherein the opposite teeth are shown vertically staggered in accordance with an embodiment of the present disclosure.
Figure 12:
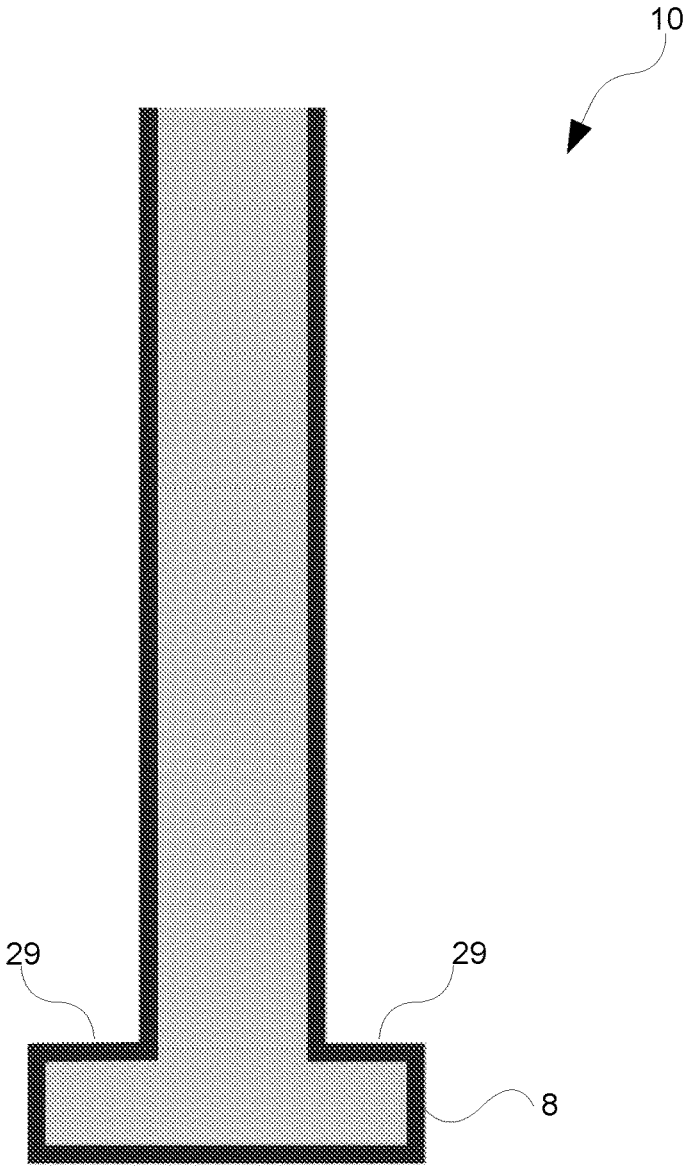
FIG. 12 shows a further configuration of the outwardly orientated strap mating formations in accordance with an embodiment of the present disclosure.

Turning now to FIGS. 7, 8 and 12, there is shown the mating end 10 in further detail.

Specifically, as can be seen in the embodiments shown in FIGS. 7 and 8, the outwardly orientated strap mating formations 8 comprise teeth which, as alluded to above, are symmetric along the widthwise axis of the mating end.

Figure 11:
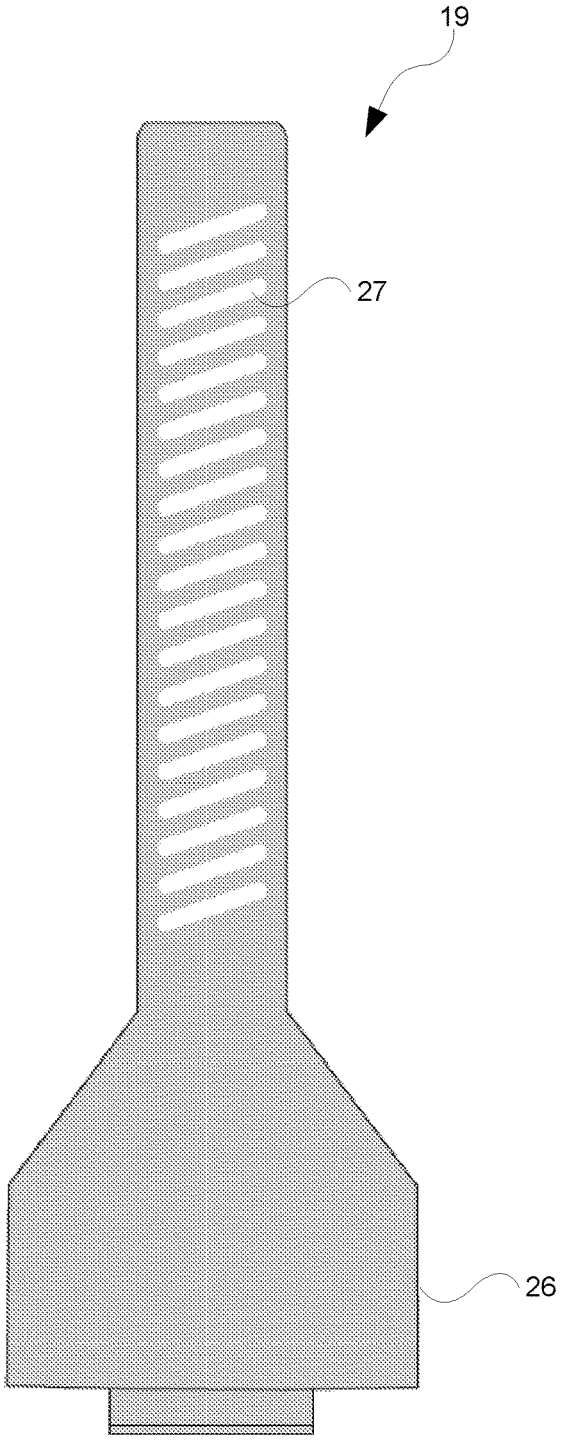
FIG. 11 shows a side elevation view of the stem of the embodiment of FIG. 10 in accordance with an embodiment of the present disclosure.

It should be noted however that differing mechanical arrangements as opposed to teeth may be applicable within the purposive scope of substantially preventing the mating end 10 from being lifted from the connection recess 12 while allowing the mating end 10 to travel along the connection recess 12 such as that which is substantially shown in FIG. 11 wherein the mating end 10 comprises a bar extending along the width of the mating ended 8 and having a depth greater than that of the mating end 10 so as to define opposite upwardly orientated ledges for engaging complimentary downward orientated ledges of the sidewalls of the connection recess 12.

In the embodiment shown in FIG. 7 and FIG. 8, the opposing teeth 8 are preferably vertically staggered so as to avoid unduly thinning the mating end 10.

Furthermore, in the embodiment shown in FIG. 7, the teeth 8 have an upwardly orientated sawtooth cross-section configuration so as to allow the insertion of the mating end 10 into the connection recess 12 along the elongate axis of the stem 19. In this manner, the mating end 10 can be pushed into the connection recess 12 for connection wherein, once utilised, may be slid from the connection recess along the lengthwise axis of the connection recess 12 in the manner described herein.

The teeth may also bias the teeth 8 against being pulled from the connection recess 12.

In embodiments, the vertical staggering of the opposite teeth 8 directionally keys the mating end 10 such that the mating end 10 can only be inserted into the connection recess 12 in one direction.

In this regard, the stem 19 may further comprise a release direction indicator indicating the direction for release such that, in use, the user is able to ascertain the appropriate direction in which to move the stem 19 for disengagement.

However, in alternative embodiments, two adjacent disconnection recesses 7 may be located at either end of the connection recess 12 so as to allow the stem 19 to be released in either direction. In this embodiment, the connection recess 12 may comprise an interference (such as a protrusion configured to locate within a complimentary notch of the mating end 10) so as to bias or catch the mating end 10 at an appropriate location so as to substantially centrally locate the stem 19 and a substantial midpoint of the lower clamping member 4.

Turning again to FIG. 3, in embodiments, the lower surface 16 of the lower clamping member 20 may be substantially convex so as to allow the lower clamping member 20 to glide across setting tile adhesive. Furthermore, the upper surface area of the lower clamping member 20 be substantially planar so as to define the upwardly acting clamping phase 14.

In embodiments, the offset adjusting mechanism between the upper clamping member 4 and the stem 19 may comprise a screwing mechanism.

Figure 6:
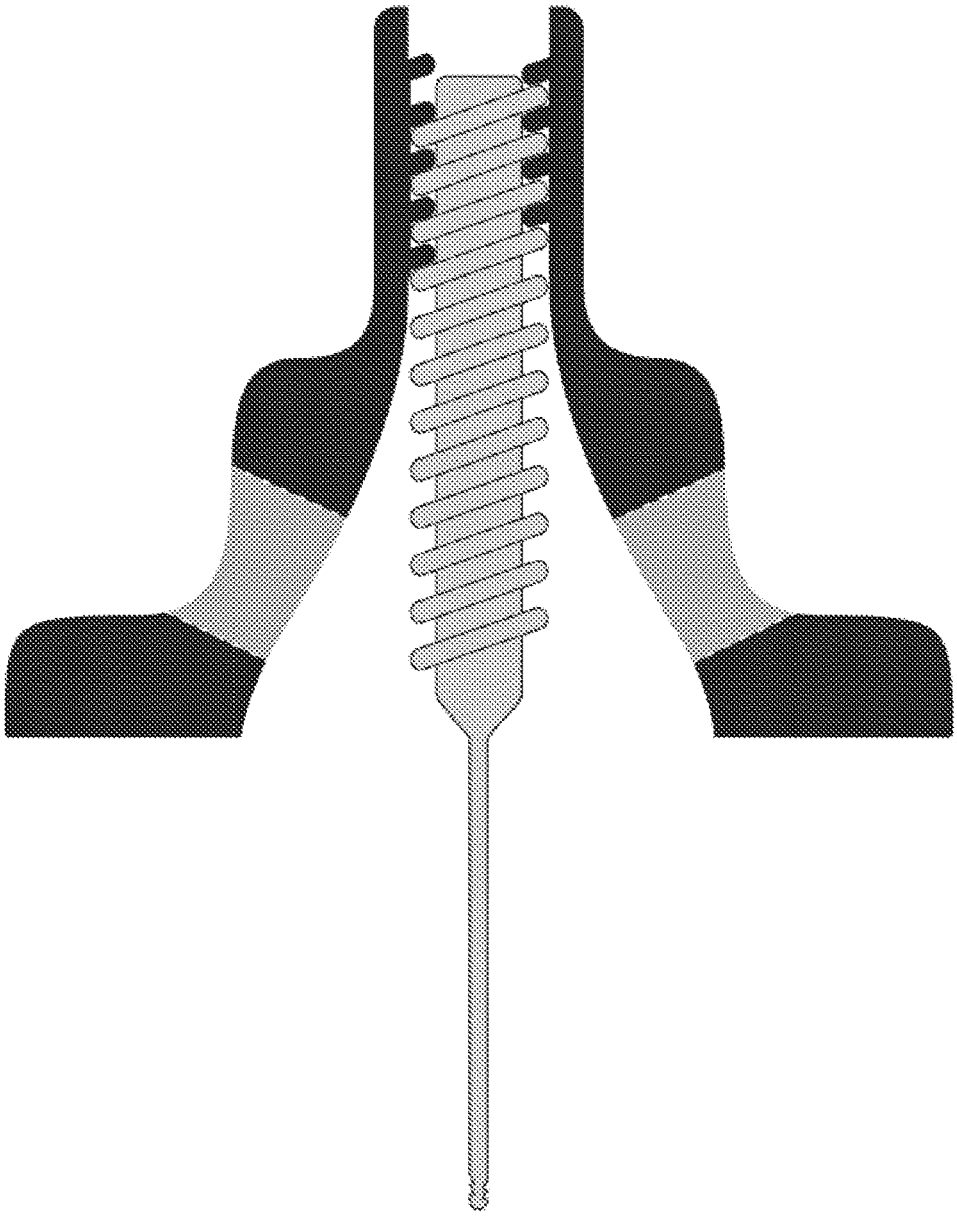
FIG. 6 shows the device illustrating the offset adjustment of the stem with respect to the upper clamping member in accordance with an embodiment of the present disclosure.

Specifically, in the embodiment shown in FIG. 3, the stem 19 comprises a cylindrical threaded portion 18 for screwing within a complimentary threaded aperture of the upper clamping member 4. In this manner, by rotating the upper clamping member 4 with respect to the stem 19, the relative offset of the stem 19 with respect to the upper clamping member 4 may be adjusted such as which is illustrated further in FIG. 6.

In embodiments, the upper clamping member 4 may be manually rotated while the stem 19 remains statically fixed within the connection recess 12. In this manner, the upper clamping member 4 may define gripping wings 5 for facilitating gripping of the upper clamping member 4 for screwing.

In additional or alternative embodiments, the upper threaded aperture portion 3 of the upper clamping member 4 may comprise a hex or other nut outer profile so as to allow the rotation of the upper clamping member 14 utilising an electric power tool.

Figure 9:
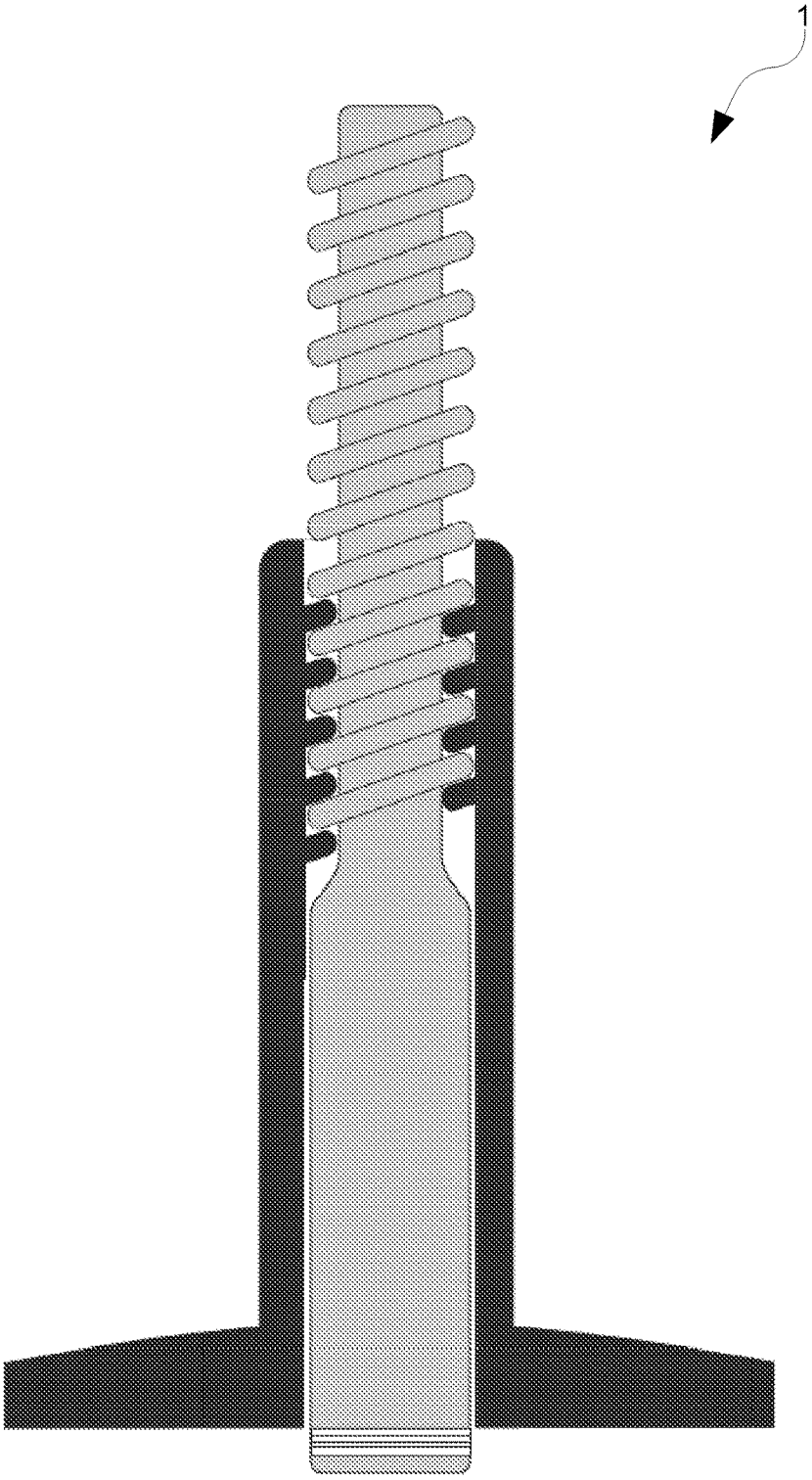
FIG. 9 shows a device for tile edge setting in accordance with a further embodiment of the present disclosure.

In alternative embodiments, alternative arrangements may be utilised to adjust the offset of the stem 19 with respect to the upper clamping member 4 as opposed to the screwing mechanism as substantially shown in FIGS. 3 and 9.

Figure 10:
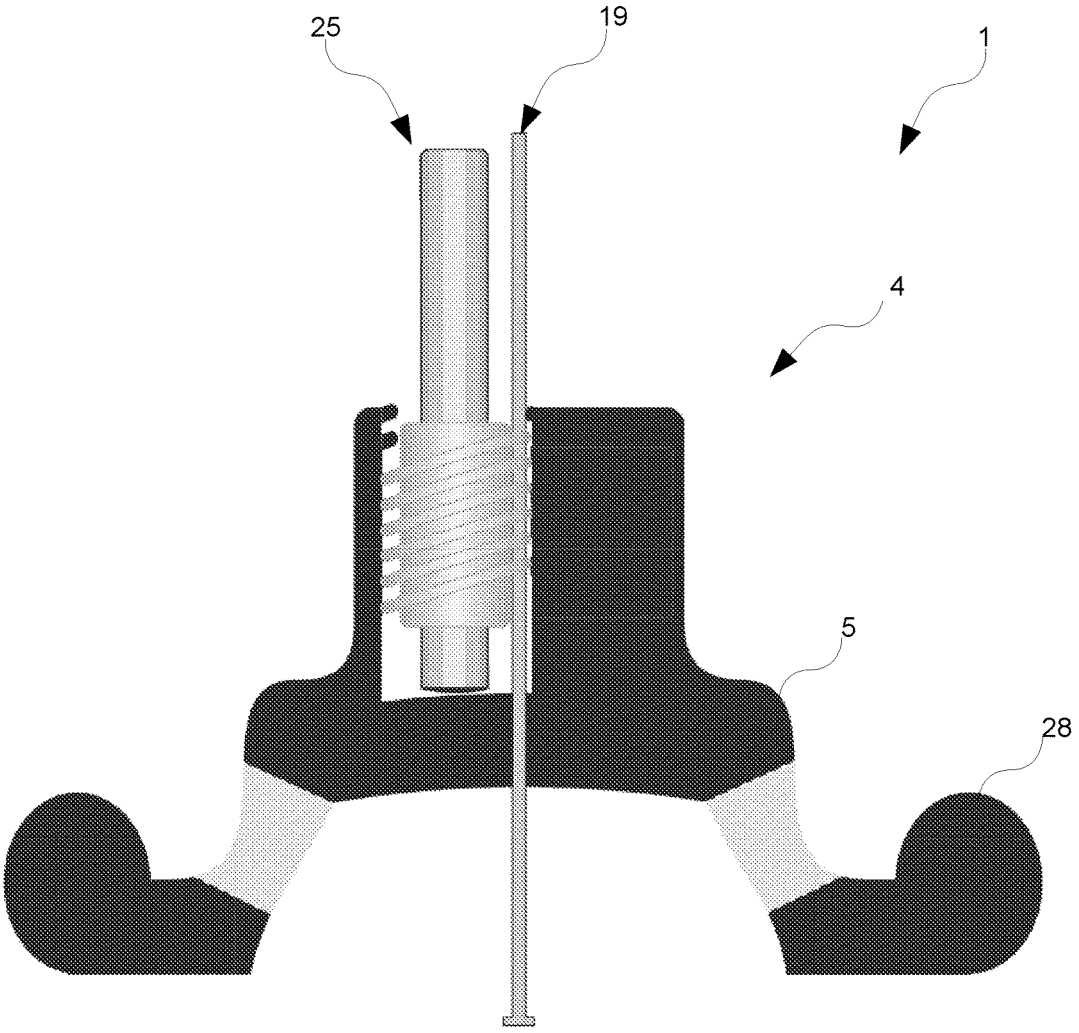
FIG. 10 shows an alternative embodiment of the device comprising a worm drive for adjusting the offset of the stem with respect to the upper clamping member in accordance with an embodiment of the present disclosure.

For example, FIG. 10 shows a further embodiment comprising an alternative offset adjusting mechanism configured for adjusting the relative offset of the stem 19 with respect to the upper clamping member 4.

Specifically, in this embodiment, the offset adjusting mechanism comprises a worm drive 15 comprising a threaded portion configured to mesh with complimentary meshing of a substantially planar stem 19. In this embodiment, the upper clamping member 20 need not be rotated when adjusting the offset of the stem 19.

A cross-sectional elevation view of such a planar stem is substantially provided in FIG. 11 wherein the angled meshing 27 for meshing with the thread of the worm drive 25 as shown.

The worm 25 drive may further comprise a coupling portion extending therefrom for coupling with a screwdriver, spanner, or other tool for the purposes of rotating the worm drive 25 so as to adjust the relative offset of the planar stem 19.

In a preferred embodiment, the coupling portion comprises a hex nut profile or similar so as to allow for ease of engagement by an electric power tool.

Also, in the embodiment shown in FIG. 10, the upper clamping member 4 may further comprise additional peripherally located manual screwing facilitating gripping wings 28 which may be used in addition or alternative to the above-described manual screwing facilitating gripping wings 5.

In the embodiment shown in FIG. 11, the interstitial strap portion of the stem 19 may be widened by way widened portion 26. In this regard, trial and experimentation has found that the widened portion 26 confers bending and twisting resistance of the stem 19 during engagement and disengagement.

In further embodiments, the upper clamping member 4 may comprise a spring member or the like which may be loaded with force so as to comprise potential energy for acting on the stem 19 and bearing against the upper tile surface. For example, in one embodiment, the spring member may comprise a coiled spring acting on the stem 19 to force the stem 19 vertically with respect to the upper clamping member 4.

Figure 13:
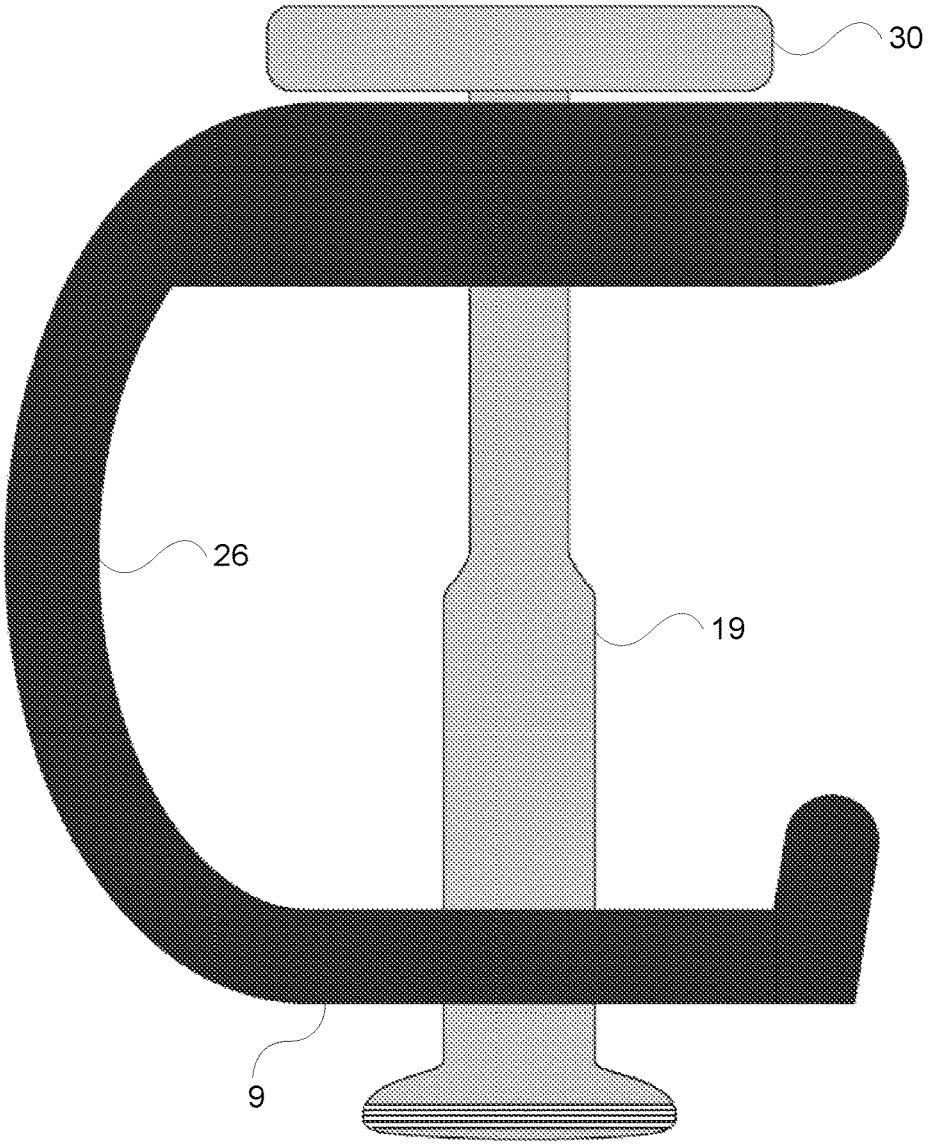
FIG. 13 shows a further embodiment of the device wherein the upper clamping member takes the form of a spring member configured for bending for storing potential energy for acting on the stem and bearing downwardly on the upper surface of the tiles in use in accordance with an embodiment of the present disclosure.

FIG. 13 shows an alternative embodiment wherein the upper clamping member 4 takes the form of a substantially C-shaped spring member portion which may be bent during engagement such that the lower clamping face 9 of the C-shaped spring member upper clamping member 4 bear 5 downwardly on the upper tile surface.

In the embodiment of FIG. 13, the outwardly orientated strap mating formations 8 may take the angled sawtooth configuration as substantially shown in FIG. 7 so as to allow the mating end 10 to be pushed into the connection recess 12 along the elongate axis of the stem 19 wherein, once the tile adhesive has set, the mating end 10 may be slid from the connection recess 12 in the manner described herein for disconnection.

As such, the mating end 10 may be pushed into the connection recess 12 prior to locating the lower clapping member 20 beneath the edge of the tile or alternatively the mating end 10 may be pushed into the connection recess 12 of the lower clamping member 20 once the lower clamping member 20 has already been located under one edge of a tile or both edges of adjacent tiles.

In embodiment shown in FIG. 13, the stem 19 may extend through an upper aperture of the upper clamping member 4 and comprise a handle or other engagement to bear downwardly on the upper surface of the upper clamping member 20 so as to allow the upper clamping member 20 to act on the handle or other engagement 30 and therefore to act on the stem 19.

In embodiment, the upper clamping member 4 may be coupled to the stem 19 by way of a pivot so as to allow the upper clamping member 4 to be swung with respect to the stem 19 for connection and disconnection.

In embodiment shown in FIG. 3, the upper clamping member 4 may be substantially bell or cone shaped having the connection aperture portion 3 at the apex and reaching to lower skirting defining the downwardly acting clamping face 9. Angled radial arms may extend between the upper threaded aperture portion 3 and the circular skirting including so as to define voids 6 therebetween which may be utilised as portals for viewing the interstitial strap 7 beneath the upper clamping member 4.

In embodiments, the lower camping member 20 defines at least one upwardly projecting grouting spacing member 7 which may be utilised for appropriately spacing the tiles apart when setting.

Turning now to FIG. 4, there is shown the top plan view of the lower clamping member 20 showing the grouting spacing members 17 in further detail. As can be seen, in this embodiment, the at least one grouting spacing member 70 may be elongate. Furthermore, as is shown in FIG. 4, the lower clamping member 20 may define two grouting spacing members 17 aligned orthogonal to the lengthwise axis of the connection recess 12 and respectively located oppositely adjacent the connection recess 12.

Furthermore, the grouting spacing member 17 may have a thickness substantially the same as the thickness of the interstitial strap portion 7. In this manner, when utilising the device 1 at a tile quadrant intersection, the interstitial strap portion 7 may be utilised to space the tiles apart appropriately while the grouting spacing members 17 may be utilised to space the tiles apart along the other orthogonal edges.

In use, differing lower clamping members 20 and stems 19 may be utilised depending on the desired application. For example, differing lower camping members 20 may be selected having grouting spacing members having differing thicknesses or lower clamping members 20 devoid of grouting spacing members 17. Similarly, differing stems 19 may be utilised having differing thicknesses depending on the desired grouting spacing.

As can also be seen from FIG. 4, in embodiments, the lower clamping member 20 may comprise adhesive ports 15 allowing the tile adhesive to ooze from beneath the lower clamping member 22 adhere to the undersurface of the tiles.

Now, with respect to exemplary dimensions, the upper clamping member 20 may have a height of approximately 35 mm and a lower edge diameter of approximately 45 mm. Furthermore, the width of the mating end 10 and that of the connection recess 12 may be approximately 12 mm. For the embodiment as substantially shown in FIG. 9, the width of the mating end 10 and that of the connection recess 12 may be approximately 7 mm.

Furthermore, the length of the interstitial strap portion 7 may be approximately 20 mm.

Furthermore, the diameter of the upper cylindrical aperture portion 3 of the upper clamping member 4 may be approximately 10 mm.

Furthermore, the width of the interstitial strap 7 may be approximately 1 mm. As alluded to above, differing straps 7 having differing thicknesses may be utilised in accordance with desired grouting spacing.

Furthermore, the length of the cylindrical threaded portion 18 of the stem 19 may be approximately 30 mm.

Now, a method for tile edge setting utilising the device 1 described herein may be provided as follows.

Firstly, tile adhesive is smeared on a tiling surface such as a floor or wall surface.

Thereafter, a device 1 is selected for use. During selection, a device 1 having an interstitial strap 7 having an appropriate thickness in accordance with a desired grouting spacing may be utilised.

Furthermore, the lower clamping member 20 may be similarly selected in accordance with whether grouting spacing members 17 are required (such as for a quadrant intersection) and wherein, if so, grouting spacing members 17 similarly having an appropriate thickness in accordance with the desired grouting spacing.

Thereafter, the device 1 may be configured such that mating end 10 of the stem 19 is engaged within the connection recess 12.

Thereafter, a tile is placed in the tile adhesive wherein one edge of the lower clamping member 20 is located or guided beneath an edge of the tile and wherein the lengthwise axis of the connection recess 12 is aligned in line with the edge of the tile.

An adjacent tile may then be placed next to the tile to rest upon the exposed edge of the lower clamping member 20.

The adjacent tile may be pushed against the tile until such time that both the tile and the adjacent tile bear against the opposing side walls of the interstitial strap portion 7 so as to be appropriately spaced.

Thereafter, the upper clamping member 4 may be connected to the stem 19 and rotated so as to travel downwardly such that the edges of the tile and the adjacent tile are clamped between the lower clamping member 20 and the upper clamping member 4. In embodiments, a power tool may be utilised to engage the hex nut profile of the stem aperture portion 3, set using an appropriate torque setting.

Thereafter, the tile adhesive is allowed to set.

Once having set, the upper clamping member 4 or the stem 19 is pushed in line with the edges of the tiles so as to allow the mating end 10 to travel from the connection recess 12 into the disconnection recess 11 whereafter the interstitial strap 7 may be lifted from between the edges of the tile and the adjacent tile with the under tile lower clamping member 20 remaining in place.

Prior to removing, the upper clamping member 4 may be unscrewed slightly so as to reduce the fictional engagement on the upper surface of the tile and the adjacent tile.

Thereafter, grouting may be inserted between the adjacent edges of the tiles and wherein the clamping member 4 and the stem 19 may be reused.

Interpretation

Orientation

Reference to the widthwise axis of the mating end 10 should be construed in the manner substantially shown in FIG. 3 wherein the stem 19 has a lengthwise axis (shown substantially vertically in FIG. 3) and a widthwise axis (shown substantially horizontally in FIG. 3). The thickness of the stem 19 may be referred to interchangeably as the depth.

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, FIGURE, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

SCOPE OF INVENTION

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the tiling industries.

The invention claimed is:

1. A device for tile edge setting, the device comprising:
clamping members comprising:
an upper clamping member defining a downward acting clamping face;
an under tile lower clamping member defining an upward acting clamping face; and
an elongate stem for urging the clamping members together, wherein:
the elongate stem is coupled to the upper clamping member by way of an offset adjusting mechanism configured for adjusting the relative offset of the stem with respect to the upper clamping member;
the lower clamping member defines an elongate connection recess; and
the stem comprises a distal mating end comprising opposing outwardly extending strap mating formations that are symmetric along the width axis of
the mating end
so as to be capable of movement along the length of the connection recess until the strap mating formations disengage from the recess.

2. A device for tile edge setting as claimed in claim 1, wherein the depth of the connection recess is less than the adjacent thickness of the lower clamping member such that the connection recess defines a connection recess floor, the length of the elongate connection recess is less than the width of the lower clamping member along the lengthwise axis of the connection recess and the connection recess is substantially horizontally centrally located within the lower clamping member.

3. A device for tile edge setting as claimed in claim 2, wherein the connection recess has an end wall located to limit the travel of the mating end along the lengthwise axis of the connection recess so as to locate the stem substantially horizontally centrally with respect to the lower clamping member and the lower clamping member further defines a disconnection recess in line with the lengthwise axis of the connection recess and adjoining one end of the connection recess and wherein the disconnection recess has a width greater than the width of the connection recess and a length equal or greater than the width of the mating end so as to allow for the disengagement of the outwardly orientated strap mating formations from the inwardly orientated recess mating formations.

4. A device for tile edge setting as claimed in claim 3, wherein the disconnection recess is funnelled towards the connection recess.

5. A device for tile edge setting as claimed in claim 4, wherein the depth of the disconnection recess is less than the adjacent thickness of the lower clamping member such that the disconnection recess defines a disconnection recess floor and the disconnection recess floor is ramped away from the elongate connection recess.

6. A device for tile edge setting as claimed in claim 5, wherein the connection recess floor and the disconnection recess floor are vertically aligned so as to allow for the correct alignment for the meshing of the outwardly orientated strap mating formations and the connection recess when the bottom edge of the mating end bears against at least one of the connection recess floor and the disconnection recess floor.

7. A device for tile edge setting as claimed in claim 1, wherein the outwardly orientated strap mating formations comprises teeth being symmetric along the widthwise axis of the mating end.

8. A device for tile edge setting as claimed in claim 7, wherein opposite teeth are respectively vertically staggered.

9. A device for tile edge setting as claimed in claim 7, wherein the teeth have an upwardly orientated saw tooth cross section configuration.

10. A device for tile edge setting as claimed in claim 1, wherein the recess comprises inwardly orientated recess mating formations and wherein the outwardly orientated strap mating formations and the inwardly orientated recess mating formations are directionally keyed such that the mating end can only be inserted into the connection recess in one direction.

11. A device for tile edge setting as claimed in claim 1, wherein the offset adjusting mechanism comprises a screwing mechanism.

12. A device for tile edge setting as claimed in claim 11, wherein the stem comprises a cylindrical threaded portion for screwing within a complementary threaded aperture portion of the upper clamping member.

13. A device for tile edge setting as claimed in claim 12, wherein the threaded aperture portion comprises a nut outer profile.

14. A device for tile edge setting as claimed in claim 12, wherein the upper clamping member defines manual screwing facilitating gripping wings.

15. A device for tile edge setting as claimed in claim 1, wherein the lower clamping member defines at least one upwardly projecting grouting spacing member.

16. A device for tile edge setting as claimed in claim 15, wherein the at least one grouting spacing member is elongate and aligned orthogonal the lengthwise axis of the connection recess.

17. A device for tile edge setting as claimed in claim 16, wherein the at least one grouting spacing member is two grouting spacing members located adjacent the connection recess.

18. A device for tile edge setting as claimed in claim 17, wherein the at least one grouting spacing member has a thickness substantially the same as the thickness of the interstitial strap portion.

19. A device for tile edge setting as claimed in claim 1, wherein the lower clamping member further comprises adhesive ports.

20. A method for reducing tile lippage utilising a device as claimed in claim 1, the method comprising:
providing a tiling surface;
smearing tiling adhesive on the tiling surface;

placing a tile with one side of the lower clamping member of the device beneath an edge of the tile and with the elongate connection recess aligned in line with the edge of the tile;

placing an adjacent tile with an opposite side of the lower clamping member beneath an edge of the adjacent tile;

adjusting the offset of the upper clamping member of the device with respect to the stem of the device such that the upper clamping member and the lower clamping member bear oppositely against the respective edges of the tile and the adjacent tile so as to align the edges of the tiles;

leaving the adhesive to substantially set;

moving the stem laterally between the edges of the tiles such that the mating end of the stem travels from the connection recess of the lower clamping member so as to release the stem from the lower clamping member.

* * * * *